US006354214B1

(12) United States Patent
Tokiwa

(10) Patent No.: US 6,354,214 B1
(45) Date of Patent: Mar. 12, 2002

(54) SYNCHRONOUS CONTROL SYSTEM FOR ROTARY PRINTING PRESSES

(75) Inventor: Shizurou Tokiwa, Zushi (JP)

(73) Assignee: Tokyo Kikai Seisakusho, Ltd. (JP)

( * ) Notice: Subject to any disclaimer, the term of this patent is extended or adjusted under 35 U.S.C. 154(b) by 36 days.

(21) Appl. No.: 09/639,498

(22) Filed: Aug. 15, 2000

(30) Foreign Application Priority Data

Nov. 15, 1999 (JP) ..... 11-323530

(51) Int. Cl.[7] ..... B41F 1/66
(52) U.S. Cl. ..... 101/484; 318/85
(58) Field of Search ..... 101/484; 318/700, 318/715, 721, 41, 85, 112

(56) References Cited

U.S. PATENT DOCUMENTS 5,617,788 A * 4/1997 Horiguchi et al. ..... 101/181
6,316,903 B1 * 11/2001 Shamoto ..... 318/700

FOREIGN PATENT DOCUMENTS

| | | | |
|---|---|---|---|
| JP | 4-187439 | * | 7/1992 |
| JP | 8-207233 | | 8/1996 |
| JP | 9-174819 | * | 7/1997 |
| JP | 10-114058 | * | 5/1998 |

* cited by examiner

*Primary Examiner*—John S. Hilten
*Assistant Examiner*—Charles H. Nolan, Jr.
(74) *Attorney, Agent, or Firm*—McGlew and Tuttle, P.C.

(57) ABSTRACT

It is an object of the present invention to prevent waste when printing is made on a paper web threaded through a detour web path from a printing unit to a folding unit via other printing units in such a manner that printing images are changed while the web is being transported by changing over a plurality of printing units through which the web is passed. The control section of each printing units having a detour web path is adapted so that it can produce a phase correction value so as to correct a drive reference speed signal with a signal relating to the difference between a drive reference phase and a corrected phase and a feedback speed signal.

11 Claims, 11 Drawing Sheets

S
T F
X
M C C C

SYNCHRONOUS CONTROL SYSTEM FOR ROTARY PRINTING PRESSES

FIELD OF THE INVENTION

The present invention relates generally to a synchronous control system for rotary printing presses, and more particularly to a synchronous control system for rotary printing presses in which driving means for independently driving a plurality of printing units and a folding unit for cutting and folding a printed paper web into predetermined printed images, and control sections for controlling the driving means for driving the printing units are provided; at least one printing unit having a direct web path running from the printing unit in question to the folding unit and a detour web path running from the printing unit in question to the folding unit via other printing units; the synchronous control system is effective at printing on the paper web passed through the detour web path in such a manner that printing images are changed while the web is being transported by changing over the printing units through which the paper web is passed, and is capable of overprinting on the paper web passed through the detour web path by simultaneously operating the printing units through which the web is passed.

BACKGROUND OF THE INVENTION

The aforementioned rotary printing press, which is a rotary printing press comprising a plurality of printing units and a folding unit for cutting and folding a printed paper web into predetermined printing images; each of the printing and folding units being driven separately by an independent driving means; each of the printing units having a direct web path running from the printing unit in question directly to the folding unit and a detour web path running from the printing unit to the folding unit via other printing units; the rotary printing press capable of printing on the paper web passed through the detour web path in such a manner that printing images are changed while the web is being transported by changing over the printing units through which the web is passed, is disclosed in Japanese Published Unexamined Patent Application No. Hei-8(1996)-207233.

Japanese Published Unexamined Patent Application No. Hei-8(1996)-207233, however, discloses only a rough outline of the control of the rotary printing press, but not in detail. In particular, there is no mention in the document of preliminary measures to cope with changes in the length of a paper web path from the printing position to the cutting and folding position before and after the changeover of the printing units.

In a rotary printing press having a plurality of printing units and a folding unit for cutting and folding the printed paper web into predetermined printing images, each of the units driven separately by independent driving means, reference points are provided on the printing cylinder of the printing unit and the rotating cylinder of the folding unit so that when the printing and folding units are rotated, the reference points of both cylinders are in synchronism with each other to obtain a reference rotating phase that is a predetermined rotating phase. Based on the reference rotating phase thus obtained, the rotating speed and the rotating phases of both cylinders are caused to agree with each other. As a result, when the paper web is passed on a particular web path where the length up to the cutting position of the folding unit is a predetermined length, the position at which the printing image printed by the printing unit is to be cut agrees with the position at which the folding unit cuts the paper web.

For this reason, changes in the length of the web path from the printing position to the cutting position on the folding unit before and after the changeover of the printing units cause a shift in the position of the cutting line with respect to a predetermined printing image. This has often produced defective prints (waste) in the conventional type of rotary printing press.

To prevent this, there has been proposed a method where the reference rotating phase of the printing cylinder, particularly the plate cylinder, as a driven section of the printing unit is determined in accordance with the length from the printing position of the printing unit to the cutting position of the folding unit for each paper web path so that the printing cylinder of the printing unit being changed over is driven at a reference rotating phase suitable for the paper web path in question.

Each printing unit, however, has a specific reference rotating phase for a typical direct web path through which the paper web is usually passed directly to the folding unit. It is therefore not practical to preset a reference rotating phase for each paper web path because of the need for a large number of reference rotating phases. Furthermore, designating a necessary reference rotating phase could lead to mistakes in selection.

Setting a reference rotating phase for several detour web paths running by way of other printing units could increase the risk of mistakes in selection since a larger number of reference rotating phases might be required in some cases where a number of direct web paths for other printing units are set as branches in the downstream side.

Even when a reference rotating phase is set for the printing cylinder of each printing unit to match a relatively longer path from the printing position of the printing unit to the cutting position of the folding unit, the differences in the elongation of travelling paper webs resulting from differences in the physical properties, such as Young's modulus, of paper webs used could lead to a significant difference in elongation as accumulated in the paper web path up to the cutting position of the folding unit. This could cause a shift in the position of cutting lines in cutting predetermined printing images on the web. In the conventional type of rotary printing press, it has been necessary, therefore, to correct the shift by operating an adjust roller device provided in the downstream of the paper web path and in the upstream of the folding unit.

With the aforementioned method, the differences in the elongation of paper webs used resulting from differences in the physical properties thereof could lead to a significant difference at the cutting position in the folding unit even when there are no mistakes in selecting the reference rotating phase, not to speak of cases where there have committed mistakes in selecting the reference rotating phase. This could cause a shift in the position of cutting lines for cutting printing images, involving corrective operations. Furthermore, a large amount of defective prints could be produced even during these corrective operations.

SUMMARY OF THE INVENTION

The present invention has been conceived taking into account these problems. In a rotary printing press comprising a plurality of printing units and a folding unit for cutting and folding a printed paper web into predetermined printing images, the object of the present invention is to prevent waste when printing is carried out, by changing printing images while the paper web, which is passed through a detour web path from one printing unit to the folding unit via the other printing units, is kept travelling by changing over the printing units through which the paper web is passed.

It is another object of the present invention to make it possible to overprint printing images on a paper web, which is passed through a detour web path from one of the printing unit to the folding unit via the other printers, by simultaneously operating the printing units through which the paper web is passed.

To achieve the above objectives, the present invention is characterized in that in a synchronous control system for a rotary printing press in which driving means for independently driving a plurality of printing units and a folding unit for cutting and folding a printed paper web into predetermined printing images are provided, and control sections for controlling the driving means for each unit are provided; at least one printing unit having a direct web path from the printing unit to the folding unit, and a detour web path to the folding unit via the other printing units, the control section of a printing unit having a detour web path comprises a phase correction value output section for generating a phase correction value on the basis of the length of a path between the printing unit in question and another printing unit in the detour web path, a signal output section for generating an appropriate signal representing a drive reference speed on the basis of a given drive reference, and a signal output section for generating an appropriate signal representing a drive reference phase, and a signal output section for generating an appropriate signal representing a feedback speed on the basis of a given feedback signal, and a signal output section for generating an appropriate signal representing a corrected phase obtained by correcting the feedback speed on the basis of the feedback signal with a phase correction value, a control signal is generated by correcting a drive reference speed signal with a signal relating to the difference between the drive reference phase and the corrected phase and a feedback speed signal, and the drive of the printing unit is controlled by the control signal.

When printing is made on a paper web passed through a detour web path by changing printing images by changing over a plurality of printing units through which the web is passed, or when printing images are overprinted on a paper web passed through a detour web path by simultaneously operating a plurality of printing units through which the paper web is passed, the present invention having the aforementioned construction exercises control in such a manner that the rotating phase of the driven part of a printing unit in the upstream side of the detour web path is in agreement with, and in synchronism with, the reference rotating phase of the driven part of the printing unit at a position at which the paper web leaving the printing unit directly reaches the folding unit.

With this control, the positions of printing images to be printed by a plurality of printing units through which the paper web is passed agree with each other. Consequently, when printing images are changed by changing over the printing units, no shift is caused in the positions of cutting lines for cutting the printing images even after the printing units are changed since the printing image after change is printed at a position at which the printing image before change would have been printed.

DETAILED DESCRIPTION OF PREFERRED EMBODIMENTS

Figure 1:
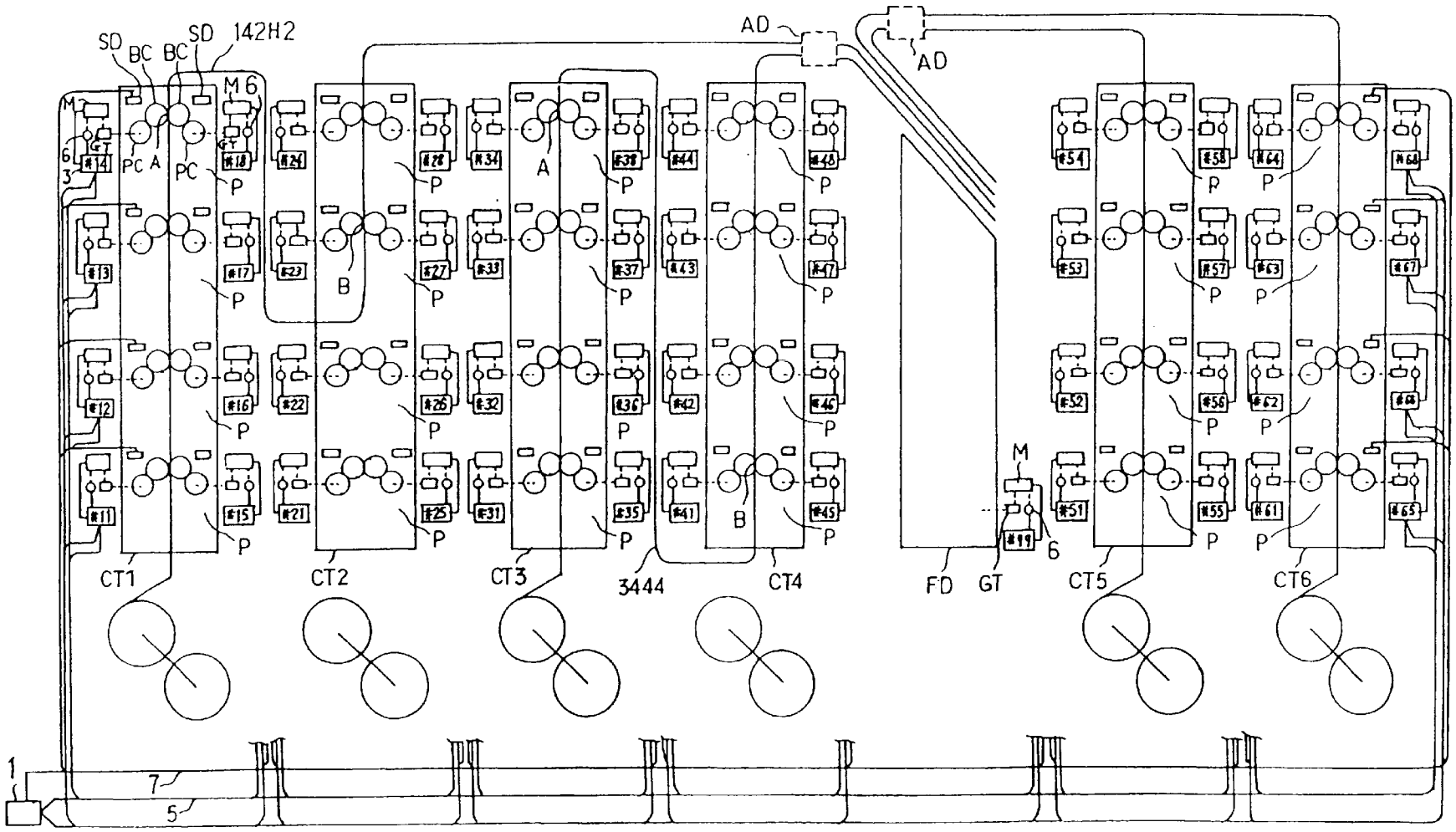
FIG. 1 is a block diagram showing the first embodiment of a synchronous control system for rotary printing presses according to the present invention.

In the following, preferred embodiments of the invention will be described, referring to the accompanying drawings.

Reference numeral 1 in the drawings refers to a master control section, 3 to a slave control section, 5 to a network line, 6 to a rotary encoder with Z phase, 7 to a signal line, 11 to an input operation section, 12 to a processing section, 13 to a drive reference setting section, 13*a* to a temporary drive reference setting section, 14 to a master pulse signal output section, 15 to a speed setting section, 16 to a phase setting section, 17 to a master network connecting section, 18 to a memory section, 19 to a power input changeover signal output section, 31 to a slave network connecting section (drive reference receiving section), 32 to a drive reference speed signal output section, 33 to a drive reference phase signal output section, 34 to a phase difference detecting section, 35 to a phase difference signal output section, 36 to a first speed correcting section, 37 to a corrected phase signal output section, 38 to a feedback signal receiving section, 39 to a feedback speed signal output section, 40 to a second speed correcting section, 41 to a motor driver, 42 to a phase correction value output section, 43 to a phase correcting signal output section, 142H2 to an inter-printing unit path of a detour web path, 3444 to an inter-printing unit path of a detour web path, A to the most downstream-side printing position on the detour web path of the upstream-side printing unit on the inter-printing unit path, AD to an adjust roller device, B to the most upstream-side printing position on the detour web path of the downstream-side printing unit on the inter-printing unit path, BC to a blanket cylinder, CT1, CT2, CT3, CT4, CT5 and CT6 to printing units, FD to a folding unit, GT to a transmission means, M to a driving means, P to a printing section, PC to a plating cylinder, PP to an impression cylinder, and SD to a power input changeover means, respectively.

As shown in FIG. 1, the first embodiment of the present invention is a synchronous control system for a rotary printing press comprising printing units CT1, CT2, CT3. CT4, CT5 and CT6 each having four printing sections P, and a folding unit FD for cutting and folding a printed web into predetermined printing images.

Each of the printing units CT1, CT2, CT3, CT4, CT5 and CT6 has a direct web path running from each of the printing units CT1, CT2, CT3, CT4, CT5 and CT6 directly to the folding unit FD (FIG. 1 shows only web paths from each of the printing units CT5 and CT6 to the folding unit FD), and a detour web path running from each of the printing units CT1, CT2, CT3, CT4, CT5 and CT6 to the folding unit FD via any of the other printing units CT1, CT2, CT3, CT4, CT5 and CT6 (FIG. 1 shows only a web path running from the printing unit CT1 to the folding unit FD via the printing unit CT2, and a web path running from the printing unit CT3 to the folding unit FD via the printing unit CT4).

Each of the printing sections P in the printing units CT1, CT2, CT3, CT4, CT5 and CT6 has two sets of printing couples each comprising a blanket cylinder BC and a plate cylinder PC. The printing section P has a printing cylinder moving mechanism (not shown) for causing a printing cylinder to move to a printing position at which the blanket cylinders BC of each printing couple make contact with each other, and to a non-printing position at which the blanket cylinders BC of each printing couple separate from each other, and a power input changeover means SD for operating the printing cylinder moving mechanism.

Each printing couple is such that the plate cylinder PC is driven by the driving means M, such as a motor, via the transmission means GT, and the blanket cylinder BC is driven by the driving means M via the plate cylinder PC, and a transmission means (not shown) provided between the plate cylinder PC and the blanket cylinder BC. That is, each of the printing units CT1, CT2, CT3, CT4, CT5 and CT6 is driven separately by an independent driving means M.

The folding unit FD is such that a folding cylinder (not shown) is driven by the driving means M via the transmission means GT, and the other cylinder is driven by the driving means M via a transmission means (not shown) provided between the folding cylinder and the other cylinder.

There can also be a construction where the plate cylinder PC or the folding cylinder (not shown) is driven directly by the output shaft of the driving means M by omitting the transmission means GT between the driving means M and the plate cylinder PC or between the driving means M and the folding cylinder (not shown).

Figure 4:
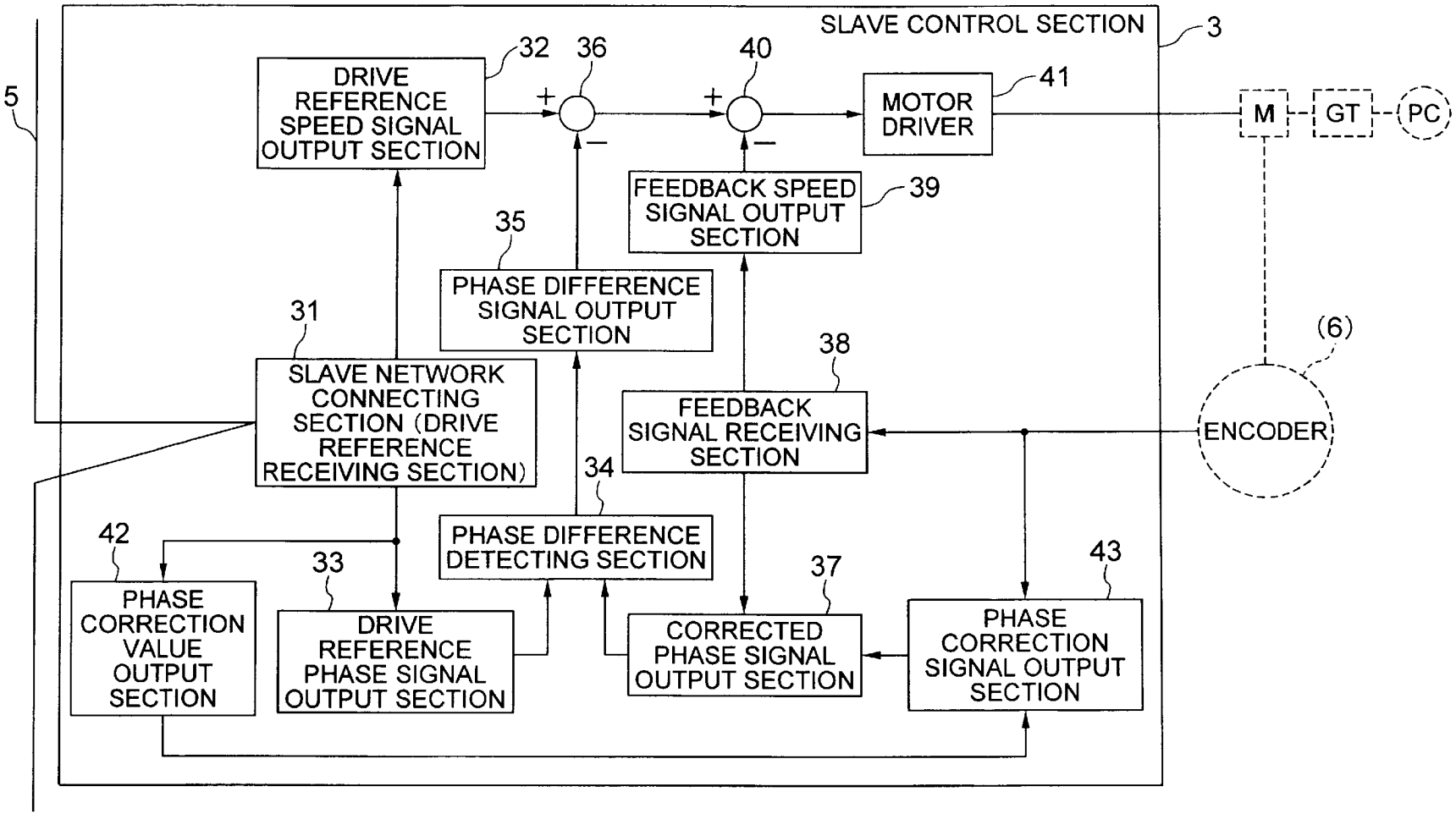
FIG. 4 is a block diagram showing an example of the slave control section shown in FIGS. 2 through 3.

The driving means M have #11~#18, #21~#28, #31~#38, #41~#48, #51~#58, #61~#68, and #99 of the slave control sections 3, and rotary encoders with Z phase 6 (hereinafter referred to as encoders for short) for generating a Z-phase pulse signal at every revolution. The slave control sections 3 are connected to a network line 5 via slave network connecting sections 31, as shown in FIG. 4 (the connection between #15~#18, #21~#28, #31~#38, #41~#48, #51~#58, #61~#64 and #99 of the slave control sections 3, and the network line 5 is omitted in the figure since it is the same as that of #11~#14 and #65~#68 of the slave control sections 3). In addition, the master control section 1 is connected to the network line 5.

There can be a construction where a plurality of master control sections 1 having functions as will be described below are provided so that they can be used by selectively changing them.

The network line 5 is constructed into a loop shape so that even when any one part of the network line 5 fails due to some trouble, signal transmission between the master control section 1 and #11~#18, #21~#28, #31~#38, #41~#48, #51~#58, and #61~#68 of the slave control sections can be maintained by the other parts.

Figure 2:
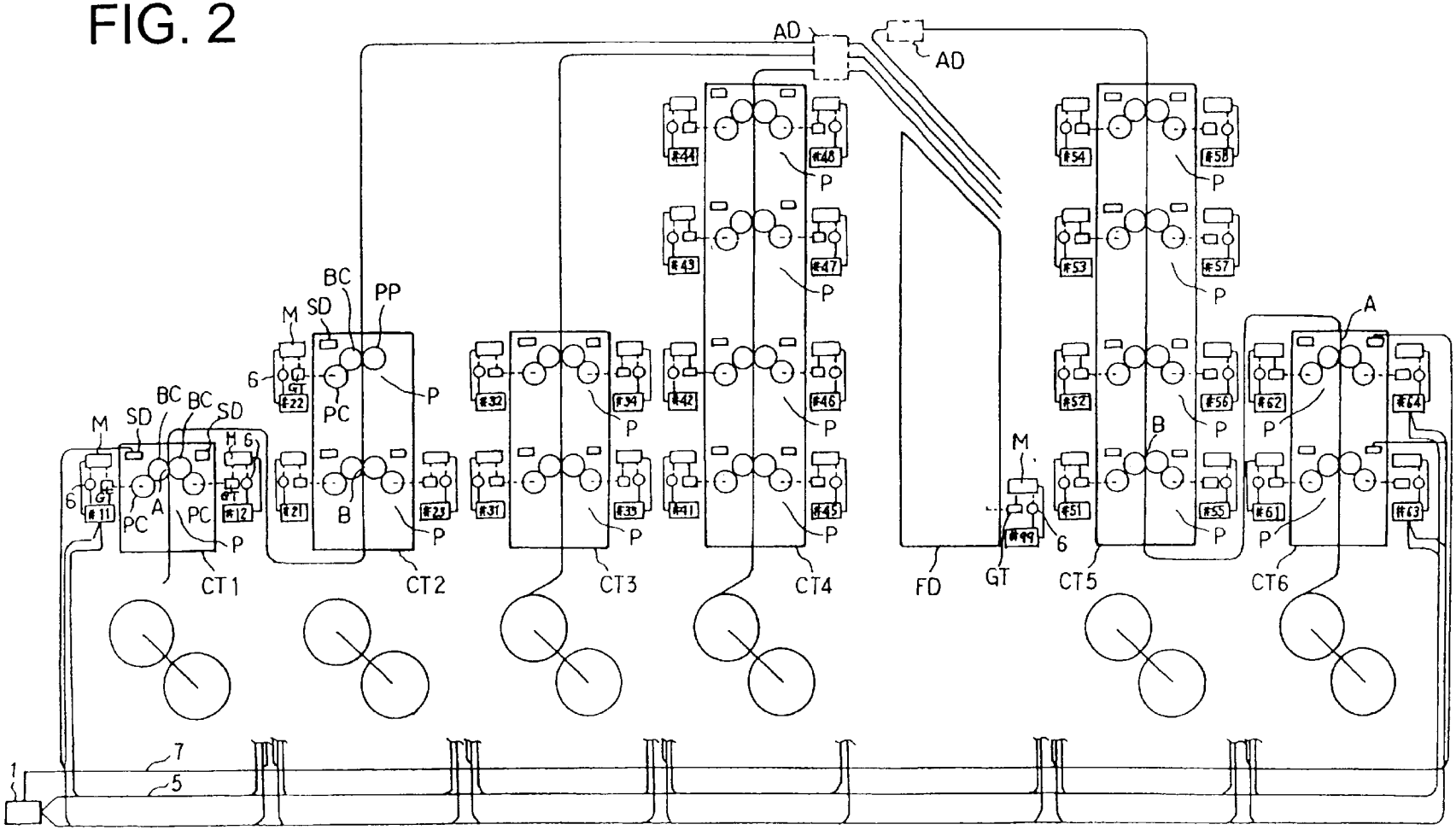
FIG. 2 is a block diagram showing the second embodiment of a synchronous control system for rotary printing presses according to the present invention.

The second embodiment shown in FIG. 2 is a synchronous control system for rotary printing presses comprising printing units CT4 and CT5 each having four printing sections P, printing units CT2, CT3 and CT6 each having two printing sections P, a printing unit CT1 having a printing section P, and a folding unit FD for cutting and folding a printed paper web into predetermined printing images.

The printing units CT1 through CT6 have direct web paths running from each of the printing units CT1 through CT6 directly to the folding unit FD (FIG. 2 shows only a path running from each of the printing units CT3 and CT4 to the folding unit FD), and detour web paths running from any one of the printing units CT1 through CT6 to the folding unit FD via the other printing units CT1 through CT6 (FIG. 2 shows a web path running from the printing unit CT1 to the folding unit FD via the printing unit CT2, and a web path running from the printing unit CT6 to the folding unit FD via the printing unit CT5).

Each printing section P in the printing units CT1 through CT6 has two sets of printing couples comprising a blanket cylinder BC and a plate cylinder PC, except for the upper printing section P of the printing unit CT2 having an impression cylinder PP in addition to a printing couple of a blanket cylinder BC and a plate cylinder PC. Each printing couple has power input changeover means SD similar to that described referring to FIG. 1.

The printing couple of each printing section P is such that the plate cylinder PC thereof is driven by the driving means M, such as a motor, via a transmission means GT, and the blanket cylinder BC thereof is driven by the driving means M via a transmission means (not shown) provided between the plate cylinder PC and the blanket cylinder BC. That is, each of the printing units CT1 through CT6 is driven by an independent driving means M. The folding unit FD is such that the folding cylinder FD thereof (not shown) is driven by a driving means M via a transmission means GT, and the other cylinder thereof is driven by the driving means M via a transmission means (not shown) provided between the folding cylinder and the other cylinder.

There can be a construction where the transmission means GT provided between the driving means M and the plate cylinder PC, or between the driving means M and the folding cylinder (not shown) is omitted, and the plate cylinder PC or the folding cylinder (not shown) is driven directly by the output shaft of the driving means M.

The driving means M have #11~#12, #21~#23, #31~#34, #41~#48, #51~#58, #61~#64 and #99 of slave control sections 3, and rotary encoders with Z phase 6 (hereinafter referred to as an encoder for short) for generating a Z-phase pulse signal at every revolution. The slave control section 3 is connected to the network line 5 via a slave network connecting section 31, which will be described referring to FIG.4.

The state of connection of the slave control sections of #12, #21~#23, #31~#34, #41~#48, #51~#58, #61~#62, and #99 with the network line 5, which is the same as that of the slave control sections 3 of #11, and #63~#64, is omitted in the figure.

Although a master control section 1 is connected to the network line 5, there can be a construction where a plurality of master control sections 1 each having functions which will be described in the following are provided and used by selectively changing them. The network line 5 is constructed into a loop shape so that even when any one part of the network line 5 fails due to some trouble, signal transmission between the master control section 1 and the slave control sections 3 of #11~#12, #21~#23, #31~#34, #41~#48, #51~#58, #61~#64, and #99 can be maintained by the other part of the line.

Figure 3:
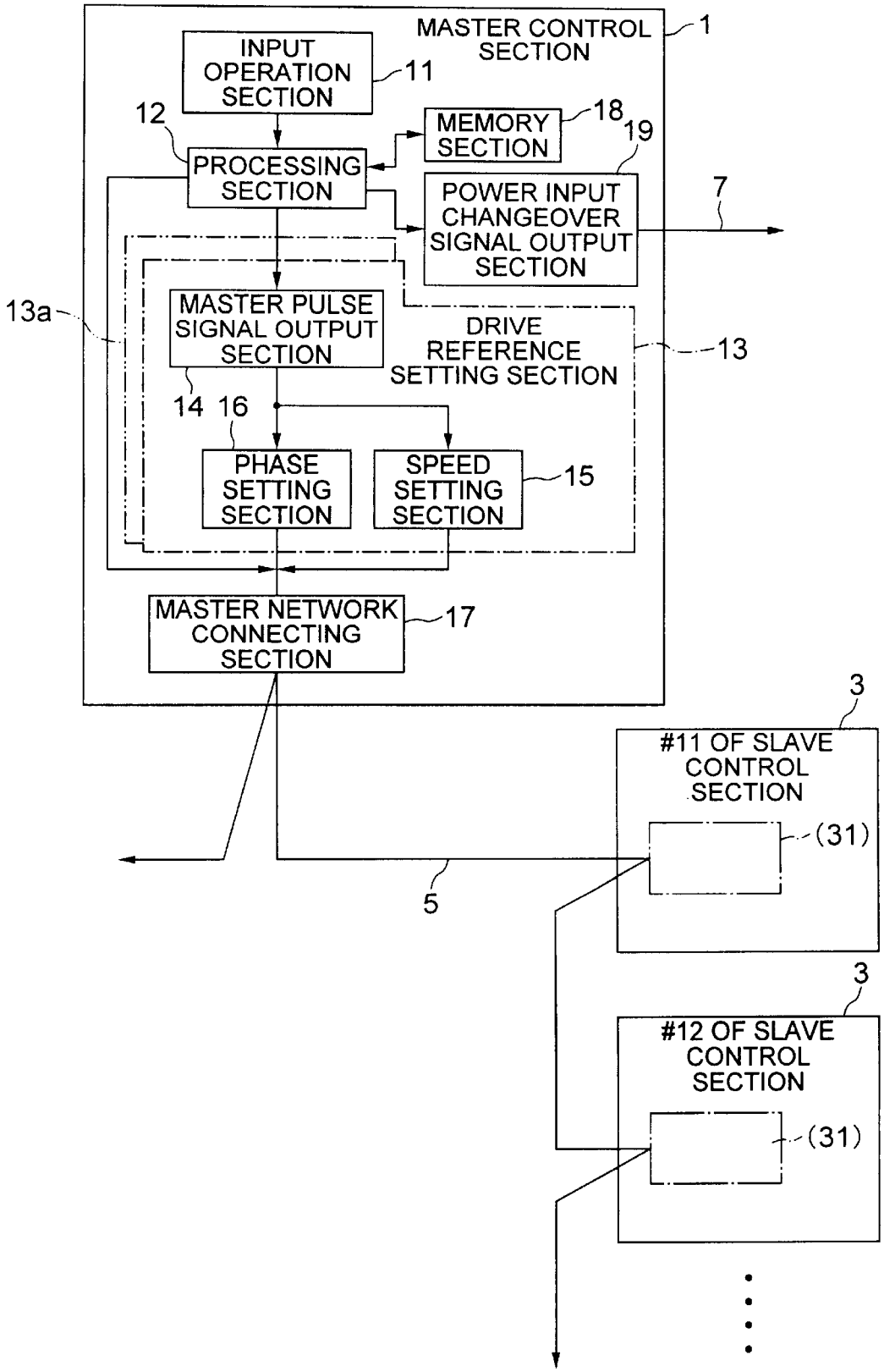
FIG. 3 is a block diagram showing an example of the master control section shown in FIGS. 1 and 2.

The master control section 1 comprises an input operation section 11, a driving reference setting section 13, a processing section 12, a master network connecting section 17, a memory section 18, and a power input changeover signal output section 19, as in the embodiment shown in FIG. 3.

The input operation section 11 is capable of entering into the memory section 18 the values of path lengths between the upstream-side printing unit and the down-streamside printing unit in the detour web path, that is, the values of the inter-printing unit path lengths, and also capable of executing initial operations to enter information on set organization, such as designation of printing sections to be used, designation of the inter-printing unit paths to be used in the detour web path, as well as of entering operation signals, such as the start, acceleration and deceleration, and stop of the press.

The memory section 18 stores the values of inter-printing unit path lengths in each detour web path entered by the input operation section 11, and phase correction values for correcting the positions of the driven parts of the printing units in relation to the path length values.

The driving reference setting section 13 sets the driving references for controlling the driving means M. The processing section 12 prepares a control range designating message by organizing rotary press sets on the basis of the set organization information entered by the input operation section 11, and makes it possible to carry out operations and driving reference setting from the input operation section 11. The processing section 12 also reads the length values of the inter-printing unit paths designated by the memory section 18 on the basis of the inter-printing unit paths in the designated detour web path, calculates the phase correction value for correcting the rotating phase of the printing cylinder of the upstream-side printing unit, or the plate cylinder PC in this embodiment, so as to match the rotating phase of the plate cylinder PC of the downstream-side printing unit, and stores and reads the calculated phase correction value in the memory section 18. The processing section 12 also issues an instruction asking the power input changeover signal output section 19 to generate a power input changeover signal, as will be described later.

The master network connecting section 17 transmits a control range designation message prepared by the processing section 12 to the network line 5, translates the phase correction value read by the memory section 18 and the driving reference set by the drive reference setting section 13 into a control message for transmission to the network line 5, and receives a response message that is response information to be transmitted by the slave control section 3 to the network line 5.

The driving reference setting section 13 has a master pulse signal output section 14, a speed setting section 15, and a phase setting section 16.

The master pulse signal output section 14 generates a first master pulse signal proportional to the speed value set by the processing section 12 on the basis of the operation signal, such as the start, acceleration/deceleration and stop of the press, entered by the input operation section 11, and generates a second master signal every time a predetermined number of the first master pulse signals are output. The first and second master pulse signals are signals having a frequency equal to that of the pulse signal generated by the encoder 6 provided corresponding to each driving means M and to that of the Z-phase pulse signal generated by the encoder 6 when the printing units are operated at a predetermined speed.

The speed setting section 15 sets the driving reference speed of the driving means M on the basis of the first master pulse signal generated by the master pulse signal output section 14.

The phase setting section 16 sets the driving reference phase of the printing cylinder to be driven by the driving means M on the basis of the first and second master pulse signals generated by the master pulse signal output section 14.

The power input changeover signal output section 19 generates a power input changeover signal when the changeover conditions of each printing unit connected to the power input changeover means SD provided corresponding to each printing couple via the signal line 7 (FIGS. 1 and 2 shows the state where only the power input changeover means SD provided corresponding to each printing couple on the left side of the printing unit CT1 and the power input changeover means SD provided corresponding to each printing couple on the right side of the printing unit CT6 are connected to each other via the signal line 7) are satisfied, that is, when the processing section 12 issues an instruction asking the power input signal output section 19 to generate a power input changeover signal after the corrected phase and driving speed of the printing cylinder have agreed with the drive reference phase and the drive reference speed in all the printing sections P corresponding to the printing unit that is set to carry out printing by the changeover of printing units.

The slave control section 3 comprises a slave network connecting section 31 that also serves as a drive reference receiving section, a drive reference speed signal output section 32, a drive reference phase signal output section 33, a phase correction value output section 42, a feedback signal receiving section 38, a phase correction signal output section 43, a feedback speed signal output section 39, a corrected phase signal output section 37, a phase difference detecting section 34, a phase difference signal output section 35, a first speed correcting section 36, a second speed correcting section 40, and a motor driver 41 as in the case of the embodiment shown in FIG. 4.

The slave network connecting section 31, which is a microcomputer including an interface, receives a control range designation message comprising set organization information transmitted by the master control section 1, and a control message, such as the drive reference, including the drive reference speed and the drive reference phase, and a phase correction value for correcting the rotating phase of the printing cylinder via the network line 5, transmits as necessary a response message acknowledging the receipt of a message from the master control section 1, detects when the difference value detected by the phase difference detecting section 34, which will be described later, becomes zero, and transmits a signal indicating that the corrected phase and drive speed of the printing cylinder have agreed with the drive reference phase and the drive reference speed.

The phase correction value output section 42 receives a phase correction value in a control message received by the slave network connecting section 31, and sends it to the phase correction signal output section 43.

The drive reference speed signal output section 32 converts a drive reference speed in a control message into a drive reference phase signal that is an analog signal proportional to the speed value entered by the input operation section 11 and set by the processing section 12, and outputs it.

The drive reference phase signal output section 33 receives a drive reference phase value in a control message, and outputs it in the form of an appropriate signal.

The feedback signal receiving section 38 receives a pulse signal produced by the encoder 6 corresponding to the driving means M. The feedback speed signal output section 39 calculates and converts the pulse signal produced by the encoder 6 into a driving speed signal that is an analog signal proportional to the rotating speed of the driving means M, and generates it as an output.

The corrected phase signal output section 37 corrects the rotating phase of the printing cylinder of the upstream-side printing unit on the inter-printing unit path in the detour web path on the basis of the pulse signal generated by the encoder 6 and the phase correction signal generated by the phase correction signal output section 43 so as to match the drive reference phase of the printing cylinder of the downstream-side printing unit in the inter-printing unit path in the detour web path, and generates it in the form of an appropriate signal.

The phase difference detecting section 34 detects a difference between the corrected phase of the printing cylinder and the drive reference phase on the basis of the drive reference phase generated by the drive reference phase signal output section 33 and the corrected phase signal of the printing cylinder generated by the corrected phase signal output section 37.

The phase difference signal output section 35 is a proportional-plus-integer control amplifier for converting the difference detected by the phase difference detecting section 34 into a phase difference signal that is an analog signal, and generates it as an output.

The first speed correcting section 36 corrects the drive reference speed signal generated by the drive reference speed signal output section 32 on the basis of the phase difference signal generated by the phase difference signal output section 35.

The second speed correcting section 40 corrects the first corrected speed signal corrected by the first speed correcting section 36 on the basis of the drive speed signal for the driving means M generated by the feedback speed signal output section 39.

The motor driver 41 supplies drive power to the driving means M on the basis of the second correction signal corrected by the second speed correcting section 40.

In the following, the control by the synchronous control system for rotary printing presses will be described.

Prior to the printing operation by the rotary press, the length from the most downstream-side printing position A on the detour web path for the upstream-side printing units to the most upstream-side printing position B the detour web path for the downstream-side printing units, that is, the length value L of the inter-printing unit path is entered for all the inter-printing unit paths to be used in the detour web path by the input operation section 11 of the master control section 1, and stored in the memory section 18.

When the length value L of the inter-printing unit path is entered, the processing section 12 converts the difference Xn between the drive reference phase of the printing cylinder at printing position of the upstream-side printing unit in the inter-printing unit path and the drive reference phase of the printing cylinder at the printing position of the downstream-side printing unit into the number of output pulses of the encoder 6 generated by the rotation of the driving means M using Equation ①.

$$Xn=K\times M0\times\{Ln/L0-FIX(Ln/L0)\}-Ma \quad ①$$

where

K: A predetermined number that is determined by the ratio between the revolution of the driven part and the encoder 6, which will be described later M0: The number of pulses generated by the encoder 6 during one revolution Ln: The length of an inter-printing unit path L0: The outer circumferential length of the blanket cylinder BC FIX(Ln/L0): The integer value of Ln/L0

Ma: The predetermined value obtained by converting the difference between the drive reference phase of the plate cylinder of the most upstream-side printing couple of the downstream-side printing unit in the inter-printing unit path and the drive reference phase of the plate cylinder of the most downstream-side printing couple of the upstream-side printing unit in the inter-printing unit path into the number of output pulses of the encoder 6

The difference Xn obtained is stored as a phase corrected value entered in the memory section 18.

Next, the information on set organization that designates the printing unit and the folding unit to be synchronous controlled by the master control section 1 during printing operation, and the inter-printing unit path during printing operation is entered from the input operation section 11 of the master control section 1.

In the embodiment shown in FIG. 1, for example, the set organization information in which synchronous control is carried out in the master control section 1 in such a manner that the printing units CT1 through CT6 and the folding unit FD are put together as a set, and the paper web passed through the four printing sections P of the printing unit CT1 is threaded through the inter-printing unit path 142H2 running through the upper two printing sections P of the printing unit CT2, while the paper web passed through the four printing sections of the printing unit CT3 is threaded through the inter-printing unit path 3444 passing through the four printing sections of the printing unit CT4 is entered into the master control section 1.

With this input, the processing section 12 of the master control section 1 transmits a control range designating message comprising ASCII codes to #11~#18, #23, #24, #27, #28, #31~#38, #41~#48, #51~#58, #61~#68, and #99 of the slave control sections 3, via the master network connecting section 17 and the network line 5.

Figure 5:
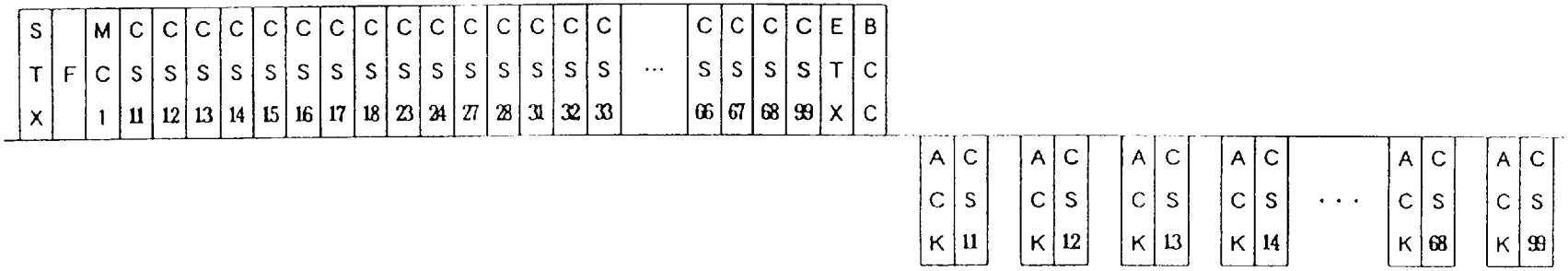
FIG. 5 is a diagram illustrating an example of the control range designating message transmitted by the master control section and the response message transmitted by the slave control section.

The control range designating message comprises a text in which a control code "F," "MC1" representing a master control section, "CS11" through "CS68" and "CS99" representing node numbers of#11~#18, #23, #24, #27, #28, #31~#38, #41~#48, #51~#58, #61~#68 and #99 of the slave control sections 3 for the printing couples as the control range in question are inserted between the start code "STX" and the end code "ETX" of the message, with a block check "BCC" attached to the text, as shown in FIG. 5.

Upon receipt of the control range designating message, the slave control section 3 returns a response message to the master control section 1 via the network line 5 to acknowledge the receipt of the control range designating message. The response message comprises "ACK" indicating the response message, and the node number of the responding slave control section 3.

Next, the processing section 12 reads from the memory section 18 a phase correction value for each inter-printing unit path as it is entered, and reduces the read value into a control message comprising ASCII codes, and transmits the control message to #11~#18 of the slave control sections 3 of the upstream-side printing unit CT1, and #31~#38 of CT3 on the inter-printing unit path via the master network connecting section 17 and the network line 5.

Transmission of this control message is carried out sequentially to each slave control section 3 while receiving a response message, which will be described later, from the slave control section 3 that is the destination of the control message.

Figure 6:
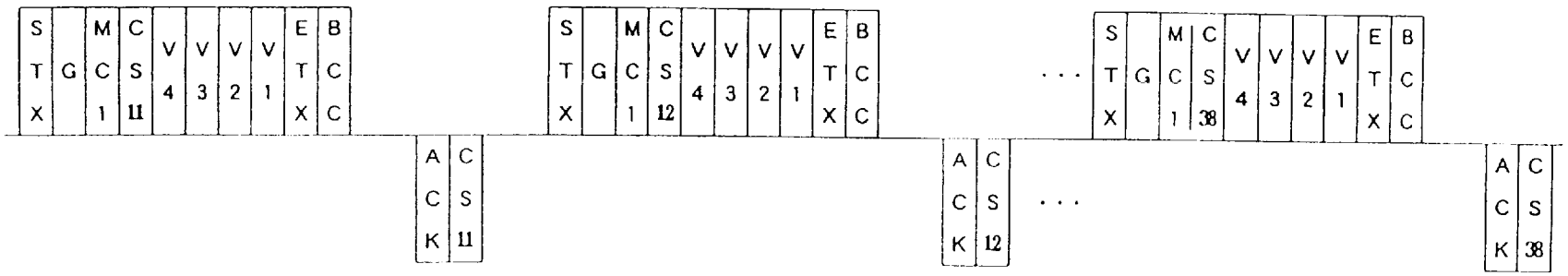
FIG. 6 is a diagram illustrating an example of the control message relating to a phase correction value transmitted by the master control section and the response message transmitted by the slave control section.
Figure 7:
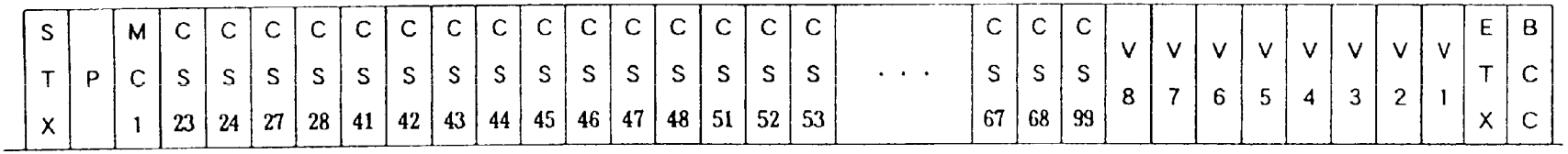
FIG. 7 is a diagram illustrating an example of a control message for carrying out printing transmitted by the master control section.

That is, this control message comprises a text having "G" indicating that this message is a phase correction value, "MC1" indicating a master control section, any of "CS11"~"CS18" and "CS31"~"CS38" indicating destinations, and "V4," "V3," "V2," and "V1" indicating phase correction values, all inserted between the start code "STX" and the end code "ETX" of the message, with a block check "BCC" added to the text sentence, as shown in FIG. 6, for example. It should be noted that "V4" through "V1" use ASCII codes from "0" to "9" and from "A" to "F," and that the phase correction value in the message used here as an example comprises 4 bytes, for example. It should also be noted that the phase correction value transmitted to "CS11"~"CS18" is usually different from the phase correction value transmitted to "CS31"~"CS38."

Each slave control section 3, to which a control message as a phase correction value is transmitted, returns a response message acknowledging the receipt of the control message comprising a phase correction value to the master control section 1. This response message comprises "ACK" indicating that it is a response message, and its own node number indicating the slave control section that responded. In this way, control and response messages are sent and received sequentially to each slave control section 3.

The phase correction value sent to the slave control section 3 is registered in the phase correction value output section 42 via the slave network connecting section 31, and is then entered from the phase correction value output section 42 into the phase correction signal output section 43. The phase correction signal output section 43 is a counter, which sets on its own the value of the difference (M0−Xn) between the entered phase correction value Xn and the number of output pulses M0 generated by the encoder 6 at every revolution as a value to be counted. In the slave control section 3 to which no phase correction value is sent, the value the phase correction signal output section 43 sets on its own as a value to be counted is "0."

These settings enables the master control section 1 to carry out the synchronous control of the rotary printing press for which set organization has been completed.

Synchronous control is such that the input operation section 11 of the master control section 1 is first switched to the operation signal input enable state, and then the printing units CT2, CT4, CT5, CT6, and the folding unit FD, for example, are designated, to which start, acceleration/deceleration, stop and other operation signals are entered from the input operation section 11.

As an operation signal is entered, the processing section 12 sets the speed value corresponding to the entered operation signal to the master pulse signal output section 14 of the drive reference setting section 13. This permits the master pulse signal output section 14 to produce a first master pulse signal corresponding to the set speed, and to produce a second master pulse signal every time a predetermined number of the first master pulse signals are produced. The first and second master pulse signals are signals having a frequency equal to that of the pulse signal produced by the encoder 6 provided corresponding to each driving means M and that of the Z-phase pulse signal produced by the encoder 6 when the rotary press is operated at the set speed.

As the master pulse signal output section 14 starts generating the aforementioned signals, the speed setting section 15 and the phase setting section 16 of the drive reference setting section 13 integrate pulse outputs generated by the master pulse signal output section 14. That is, the speed setting section 15 integrates the first master pulse signals, which are cleared by the second pulse signals. The phase setting section 16 integrates the first and second master pulse signals, while the integrated value of the first master pulse signals is cleared by the second master pulse signal, and the integrated value of the second master pulse signals is cleared every time the integrated value reaches a predetermined number.

The predetermined number at which the integrated value of the second master pulse signals is cleared is predetermined on the basis of the ratio of the revolutions of the driven part and the encoder 6. When the encoder 6 makes four turns while the driven part makes one turn, the predetermined number is "4," and when the encoder 6 makes one turn while the driven part makes one turn, the predetermined number is "1." That is, the phase setting section 16 does not necessarily have to count the second master pulse signals in the latter case.

The integrated values (including the integrated values by a temporary drive reference setting section 13*a,* which will be described later) by the speed setting section 15 and the phase setting section 16 are sent as control messages to the slave control section 3, which is included in the control range, from the master network connecting section 17 via the network line 5 at predetermined periods, or every 100 microseconds, for example.

The control message comprises a text having a control code "P" indicating that the message is a drive reference, "MC1" indicating the master control section, node numbers "CS23," "CS24," "CS27," "CS28," "CS41" through "CS48," "CS51" through "CS58," "CS61" through "CS68," and "CS99" representing the printing couples of the printing units included in the control range of CT2, CT4, CT5 and CT6, and the folding unit FD, #23, #24, #27, #28, #41~#48, #51~#58, #61~#68, and #99 of the slave control section 3, "V8" through "V5" representing the drive reference speed, and "V4" through "V1" representing the drive reference phase inserted between the start code "STX" and the end code "ETX", with a block check "BCC" attached to the text. "V8" through "V1" use "0" through "9" and "A" through "F" of ASCII codes, and both the drive reference speed and the drive reference phase comprise 4 bytes, for example, in the message shown.

These messages (including messages that will be described in the following) are transmitted to the network line 5 at a rate of 20 megabits per second, for example.

Upon receipt of the control message, each slave control section 3 sends a drive reference speed to the drive reference speed signal output section 32, and a drive reference phase to the drive reference phase signal output section 33 for further processing.

That is, the drive reference speed signal output section 32, into which the drive reference speed is entered, calculates the following equation to obtain a value S1 proportional to the speed value set by the processing section 12, and generates an analog signal corresponding to S1 as a drive reference speed signal.

$$S1=(Y2-Y1)/T$$

where Y2 is the drive reference speed that has just been entered to the drive reference speed signal output section 32; Y1 is the drive reference speed that was entered immediately before Y2; and T is a predetermined time interval in which the master control section 1 sends the control message.

When the integrated value of the first master pulse signals in the speed setting section 15 is reset by the second master pulse signal, it may happen that Y1>Y2, and as a result, S1<0. In such a case, S1 can be obtained by calculating the following equation.

$$S1=(Ym+Y2-Y1)/T$$

where Ym is the number of the first master pulses needed for the second master pulse signals to be generated, and it is a predetermined value.

The drive reference phase signal output section 33, into which the drive reference phase has been entered, replaces the previous drive reference phase with a drive reference phase that has just been entered, and generates the latest drive reference phase.

Aside from this, an output pulse signal of the encoder 6 connected to the driving means M corresponding to the slave control section 3 is entered into the feedback signal receiving section 38 and the phase correction signal output section 43; the output pulse signal sent to the feedback signal receiving section 38 is processed in the corrected phase signal output section 37 and the feedback speed signal output section 39, while the output pulse signal sent to the phase correction signal output section 43 is processed to generate a phase correction signal.

That is, the phase correction signal output section 43, in which the value to be counted (M0−Xn) has been set, as described before, starts counting the pulse signals of the encoder 6 as a Z-phase pulse signal of the encoder 6 is entered. Upon completion of the counting of the pulse signal up to (M0−Xn), a phase correction signal is generated. That is, the phase correction signal output section 43 generates a phase correction signal obtained by delaying the Z-phase pulse signal of the encoder 6 by (M0−Xn) pieces of the pulse signals of the encoder 6 (in other words, a phase correction signal obtained by advancing the Z-phase pulse signal of the encoder 6 by Xn pieces of the pulse signals of the encoder). As this phase correction signal is generated, the drive reference phase of the printing cylinder at a printing position of the upstream-side printing unit on the inter-printing unit path of the detour web path can be caused to agree with the drive reference phase of the printing cylinder at a printing position of the downstream-side printing unit on the inter-printing unit path by advancing it by Xn pieces of the pulse signals of the encoder 6 from the original drive reference phase. Consequently, the difference of the drive reference phases at printing position of the printing cylinder between the upstream-side printing unit and the downstream-side printing unit for printing on a paper web running on the inter-printing unit path, so that the printing positions on the paper web by the printing cylinders of both printing units can be agreed with each other.

When a value to be counted is "0," that is, the timing of the phase correction signal agrees with the timing of the Z-phase pulse signal of the encoder 6 in the printing unit and the folding unit for printing on a paper web that is not passed through.

The corrected phase signal output section 37 adds up the pulse signals generated by the encoder 6 and the phase correction signals generated by the phase correction signal output section 43, and outputs the integrated value as a corrected phase signal that has corrected the rotating phase of the driving section. In the integrating operation carried out by the corrected phase signal output section 37, the integrated value of pulse signals is cleared by the phase correction signal, while the integrated value of phase correction signals is cleared every time the integrated value becomes a predetermined number. The predetermined number at which the integrated value is cleared is predetermined on the basis of the ratio of the revolution of the driven part and the revolution of the encoder 6, as in the case where the integrated value of the second master pulse signals in the phase setting section 16 are cleared.

The feedback speed signal output section 39 adds up the pulse signals produced by the encoder 6, and every time the slave network connecting section 31 receives a control message, obtains a value S2 proportional to the rotating speed of the driving means M by calculating $$S2=(Y4-Y3)/T$$

where Y4 is the integrated value at that time, Y3 is the integrated value at the time when the immediately preceding message was received, and T is a predetermined time interval for the master control section 1 to send the control message. The feedback speed signal output section 39 then produces an analog signal corresponding to this value S2 as a drive speed signal. When the integrated value of pulse signals in the feedback speed signal output section 39 is reset by the Z-phase pulse signal, it may happen that Y3>Y4, and accordingly S2<0. In such a case, S2 can be obtained by calculating $$S2=(Ym+Y4-Y3)/T.$$

where Ym is the number of pulse outputs produced by the encoder 6 within the time interval where two preceding and succeeding Z-phase pulse signals are produced, and it is a predetermined value.

In the slave control section 3, moreover, the drive power sent from the motor driver 41 to the driving means M is corrected every time the slave network connecting section 31 receives a control message.

The details are as follows.

Every time the slave network connecting section 31 receives the aforementioned control message, the drive reference phase signal output section 33 produces a drive reference phase signal, as described above. This drive reference phase signal is entered into the phase difference detecting section 34 where the corrected phase signal for the rotating phase of the driven part produced by the corrected phase signal output section 37 has been entered in advance.

The phase difference detecting section 34 therefore obtains a difference between the drive reference phase and the corrected phase of the rotating phase of the driven part every time a drive reference phase signal is entered, and outputs the difference thus obtained as an output to the phase difference signal output section 35 which is an integrating amplifier. This allows the phase difference signal output section 35 to produce as a phase difference signal an analog signal corresponding to the difference entered.

As described earlier, every time the slave network connecting section 31 receives the aforementioned control message, the drive reference speed signal output section 32 outputs a drive reference speed signal that is an analog signal proportional to the speed value set by the processing section 12, and the feedback speed signal output section 39 outputs a drive speed signal that is an analog signal proportional to the rotating speed of the driving means M. The aforementioned drive reference speed signal is corrected by the phase difference signal into a first correction signal in the first speed correcting section 36, and also corrected by the drive speed signal into a second correction signal in the second speed correcting section 40. This second correction signal is entered into the motor driver 41.

Upon receipt of the second correcting signal, the motor driver 41 corrects the drive power to be fed to the driving means M so as to make it consistent with the second correction signal.

With the aforementioned control, the driven sections of the printing units CT2, CT4, CT5 and CT6, and the folding unit FD in the control range, that is, in a set of rotary press, are put into synchronous operation in which their rotating phase and speed agree with each other.

Next, the control and operation to change over from the printing unit CT2 to the printing unit CT1, and from the printing unit CT4 to the printing unit CT3 so as to change the images being printed will be described in the following.

First, an instruction is given from the input operation section 11 of the master control section 1 to change over form the printing unit CT2 to the printing unit CT1, and from the printing unit CT4 to the printing unit CT3. The processing section 12 creates a temporary drive reference setting section 13*a* corresponding to the printing units CT1 and CT3. The temporary drive reference setting section 13*a* sets the drive reference speed and a temporary rotating phase so as to carry out a predetermined sequential acceleration to cause the rotating speed of the printing cylinders of the printing units CT1 and CT3 to agree with the rotating speed of the printing cylinders of the currently operating printing units CT2 and CT4. The drive reference set by the temporary drive reference setting section 13*a* is sent as a control message to the network line 5.

Figure 8:
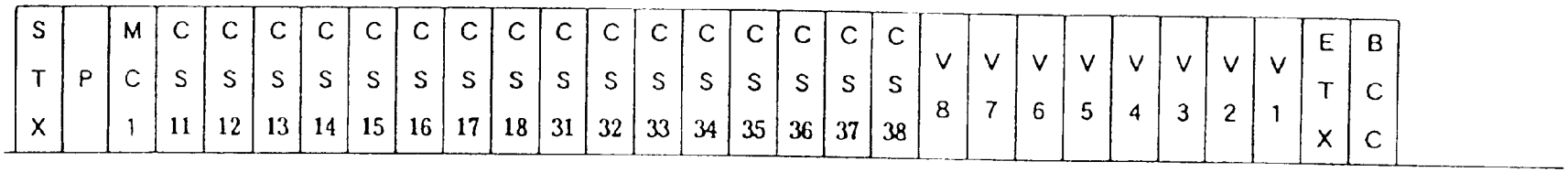
FIG. 8 is a diagram illustrating an example of a control message for speed matching transmitted by the master control section.

As shown in FIG. 8, this control message comprises a text sentence by inserting between the start code "STX" and the end code "ETX" a control code "P" indicating that the message is a drive reference, "MC1" indicating a master control section, "CS11" through "CS18" and "CS31" through "CS38" indicating the node numbers of #11~#18 and #31~#38 of the slave control sections 3 for the printing couples that are in the control range, "V8" through "V5" indicating the drive reference speed, and "V4" through "V1" indicating temporary drive reference phases. The text sentence is followed by the block check "BCC."

"V8" through "V1" here use ASCII codes of "0" through "9" and "A" through "F" and each of the drive reference speed and the temporary drive reference phase in the message shown here comprises four bytes, for example.

The drive reference speed increases during a predetermined time until it reaches the printing speed of the currently operating printing units CT2, CT4, CT5 and CT6.

The drive reference phase in this control is made "temporary" because this control does not perform a control in which the rotating phase of the printing cylinders of the printing units CT1 and CT3 is not caused to agree with the rotating phase of the printing cylinders of the currently operating printing units CT2, CT4, CT5 and CT6.

As the aforementioned control causes the rotating speed of the printing cylinders of the printing units CT1 and CT3 to agree with the rotating speed of the printing cylinders of the currently operating printing units CT2, CT4, CT5 and CT6, that is, as the outputs of the phase difference detecting section 34 provided in #11~#18, and #31~#38 of the slave control sections 3 for the printing couples of the printing units CT1 and CT3 become "0" (where there is no difference between the corrected phase of the printing couples and the temporary drive reference phase in a state where the feedback speed of the printing couples agrees with the drive reference speed) when the drive reference speed in the control message shown in FIG. 8 agrees with the drive reference speed in the control message controlling the printing units CT2, CT4, CT5 and CT6. As a result, when the slave control sections 3 transmit a signal informing that the feedback speed and the drive reference speed agree with each other via the network line 5 using the slave network connecting section 31, the master control section 1 transmits a control message acknowledging the agreement of the speeds.

Figure 9:
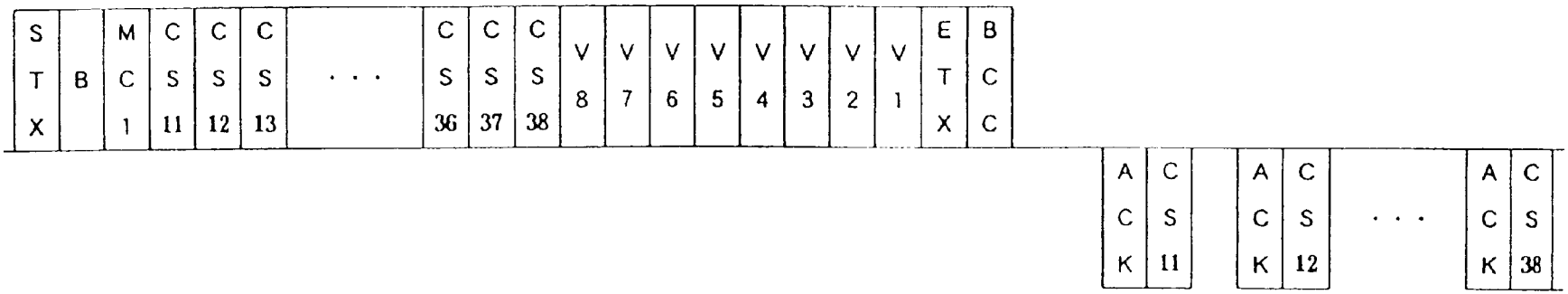
FIG. 9 is a diagram illustrating an example of a control message for acknowledging the agreement of speed or phase transmitted by the master control section and a response message transmitted by the slave control section.

The control message for acknowledging the agreement of speeds is as shown in FIG. 9.

That is, the control message for acknowledging the agreement of speeds has the same construction as the control message shown in FIG. 8, except that the control code is a control code "B" indicating that this message is for asking judgement as to the agreement of the drive reference and the actual driving state.

Upon receipt of a control message indicating the agreement of speeds, the slave control section 3 judges the agreement of the drive reference and the actual driving state and transmits a response message. This response message comprises "ACK" indicating the it is a response message, and its own node number indicating the slave control sections 3 involved.

Upon receipt of the response message relating to the agreement of speeds from the slave control sections 3 involved, the master control section 1 performs a control to cause the rotating phase of the rotating cylinders of the printing units CT1 and CT3 to agree with the rotating phase of the printing cylinders of the currently operating printing units CT2, CT4, CT5 and CT6.

That is, the master control section 1, which receives the response message relating to the agreement of speeds from the slave control sections 3 involved, transmits a control message controlling the entire set of the control range on the basis of the drive reference set by the drive reference setting section 13.

Figure 10:
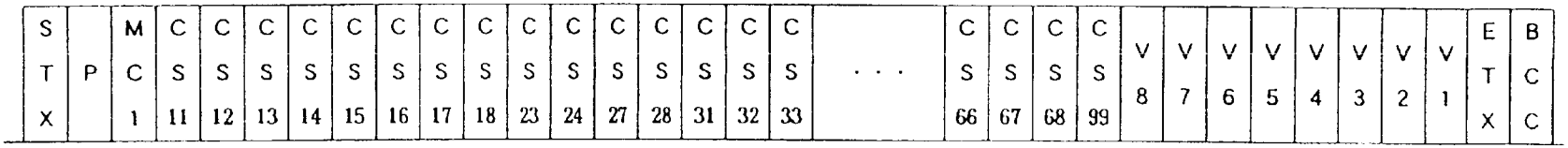
FIG. 10 is a diagram illustrating an example of a control message for rotating-phase agreement transmitted by the master control section.

As shown in FIG. 10, this control message comprises a text sentence by inserting a control code "P" indicating that this message is a drive reference, "MC1" indicating a master control section, "CS11" through "CS18,""CS23,""CS24,""CS27,""CS28,""CS31" through "CS38,""CS41" through "CS48,""CS51" through "CS58,""CS61"through "CS68" and "CS99" indicating the node numbers of the printing couples and folding units corresponding to the printing units CT1, CT2, CT3, CT4, CT5 and CT6, and #11~#18, #23, #24, #27, #28, #31~#38, #41~#48, #51~#58, #61~#68 and #99 of the slave control sections 3, "V8" through "V5" indicating drive reference speeds, and "V4" through "V1" indicating drive reference phases between the start code "STX" and end code "EXT" of the message. The text sentence is followed by a block check "BCC."

"V8" through "V5" use ASCII codes of "0" through "9" and "A" through "F," and both the drive reference speeds and the drive reference phases in the text sentence shown comprise 4 bytes, for example.

When the transmission of this control message is started, the control message for transmitting the drive reference set by the aforementioned temporary drive reference setting section 13*a* is stopped.

When this control causes the rotating phase of the printing cylinders of the printing units CT1 and CT3 to agree with the rotating phase of the printing cylinders of the currently operating printing units CT2, CT4, CT5 and CT6, that is, when with the control exercised by the control message shown in FIG. 10, the outputs of the phase difference detecting sections 34 of #11~#18, and #31~#38 of the slave control sections 3 for the printing couples of the printing units CT1 and CT3 become zero (a state where the feedback speed of the printing couples agrees with the drive reference speed, or where there is no difference between the corrected phase of the printing couples and the drive reference phase), and the slave control sections 3 transmit a signal informing that the corrected phase agrees with the drive reference phase via the network line 5 using the slave network connecting section 31, then the master control section 1 transmits a control message acknowledging the agreement of phases.

The control message for acknowledging the phase agreement has the same construction as the control message for acknowledging the speed agreement (refer to FIG. 9). The drive reference speed set by the drive reference setting section 13 is assigned to "V8" through "V5" in the message acknowledging the phase agreement, while the drive reference phase set by the drive reference setting section 13 is assigned to "V4" through "V1."

The slave control section 3 that has received the control message for acknowledging the phase agreement confirms that the actual driving state agrees with the drive reference, and sends a response message, which is the same as the response message to the control message for acknowledging the speed agreement, as described earlier.

Upon acknowledging the agreement of the rotating speed and phase of the driven part of the printing units CT1 and CT3 with the rotating speed and phase of the driven part of the currently operating printing units CT2, CT4, CT5, CT6 and the folding unit FD as a result of the aforementioned control, the master control section 1 produces a power input changeover signal for changing the printing units.

That is, the processing section 12 of the master control section 1 issues an instruction asking the power input changeover signal output section 19 to output a power input changeover signal.

Upon receipt of the instruction to output the power input changeover signal, the power input changeover signal output section 19 produces a power input changeover signal to the power input changeover means SD corresponding to the printing couples of the printing units CT1, CT2, CT3 and CT4 via the signal line 7.

Upon receipt of the power input changeover signal, the power input changeover means SD then changes over the input to operate a printing cylinder transfer mechanism, thereby transferring to the non-printing position the printing couples of the printing units CT2 and CT4 that have been in the printing position, and also transferring to the printing position the printing couples of the printing units CT1 and CT3 that have been in the non-printing position. In this way, the printing images are changed by the rotary press sets within the designated range.

After the printing images have been changed, the printing image of the printing unit CT1 is now printed at the position where the printing image of the printing unit CT2 would have to be printed, and the printing image of the printing unit CT3 is printed at the position where the printing image of the printing unit CT4 would have to be printed. As a result, the cutting lines by the folding unit FD never interfere with the changed printing images.

After the lapse of a predetermined time enough to complete the operation of the power input changeover means SD, the processing section 12 of the master control section 1 causes the printing units CT2 and CT4 to stop. That is, the temporary drive reference setting section 13a sets the drive reference speed and the temporary drive reference phase so that the rotating speed of the printing cylinders of the printing units CT2 and CT4 is caused to follow a predetermined sequential deceleration and finally to stop operation, and performs control to decelerate and stop the rotating printing couples of the printing units CT2 and CT4 in accordance with the settings.

Figure 11:
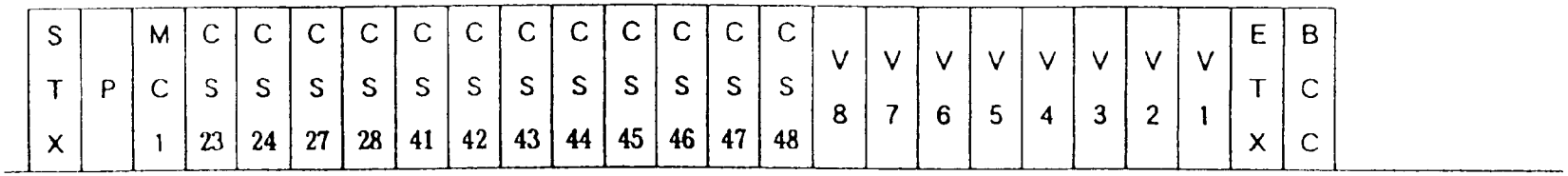
FIG. 11 is a diagram illustrating an example of a control message for speed reduction and stop transmitted by the master control section.

This control is the same as the control for sequential acceleration of the rotating speed of the printing cylinders of the printing units CT1 and CT3, except that the objects being controlled are the printing units CT2 (the upper two printing sections P) and CT4, and that the drive reference speed is decreased down to zero at each predetermined time. The control message is as shown in FIG. 11, and has the same construction as that shown in FIG. 8, though there are some differences in terms of the aforementioned two points.

With the above operations, printing images can be changed without stopping any sets of rotary presses.

In the foregoing, the control has been described, in which the printing units CT2 and CT4 are first put into operation, changing the printing unit CT2 to the printing unit CT1, and then the printing unit CT4 to the printing unit CT3. It is obvious that printing images can be changed with a similar control even when the order of the printing units that are first put into operation and the printing units that are changed over is reversed, and that printing images can be changed with a similar control for rotary presses in the second embodiment shown in FIG. 2.

In a rotary printing press where each of the printing units is driven by an independent driving means, the synchronous printing system according to the present invention can perform control so that printing can be accomplished on a paper web that is passed through a detour web path from a printing unit to a folding unit via another printing unit while registering the printing images by simultaneously bringing a plurality of the printing units through which the paper web is passed into printing operation. It is therefore very easy to overprint a single image with six types of color ink by causing the printing units CT1 and CT2 of the rotary press shown in FIG. 1 to simultaneously operate. With such a printing operation, it is quite easy to print a printing image by adding special ink, such as scented ink and fluorescent ink, to ordinary black, cyan, magenta and yellow ink. This results in printed matter having high commercial value.

[Effects of the Invention]

As described above, the present invention makes it possible to carry out printing on a paper web that is threaded through a detour web path from a printing unit to a folding unit via another printing unit in a rotary printing press where each of printing units is driven by an independent driving means by changing printing images by changing over a plurality of printing units through which the paper web is passed without stopping the rotary printing press, and to eliminate paper waste due to mismatching of printing images and cutting position because there is no fear of the cutting position by the folding unit of the paper web interfering with the printing image printed on the paper web even after the printing images are changed as a result of the changeover of the printing units since the printing position of the printing image by the printing unit that is first put into printing operation agrees with the printing position of the printing image by the printing unit that is put into printing operation later. Thus, the production cost of printed matter can be substantially reduced.

The present invention also makes it possible to print a printing image on a paper web by simultaneously putting a plurality of printing units through which the paper web is passed into printing operation in the aforementioned paper threading state.

In this printing operation, therefore, printed matter having high commercial value can be produced with a very easy operation by adding special ink, such as scented ink and fluorescent ink, to ordinary black, cyan, magenta and yellow ink.

What is claimed is:

1. A synchronous control system for rotary printing presses comprising driving means provided for independently driving each of a plurality of printing units, a folding unit for cutting and folding a printed paper web into predetermined printing images, and a control section for controlling each of the driving means for said printing and folding units; at least one printing unit having a direct web path running from said one printing unit directly to said folding unit, and a detour web path running to said folding unit via other printing units, characterized in that said control section for said printing unit having said detour web path comprises a phase correction value output section for producing a phase correction value as an output on the basis of the length of a path between said one printing unit and another printing unit in said detour web path, a signal output section for producing a drive reference speed in the form of an appropriate signal and a signal output section for producing a drive reference phase in the form of an appropriate signal on the basis of a given drive reference, and a signal output section for producing a feedback speed on the basis of a given feedback signal in the form of an appropriate signal and a signal output section for producing in the form of an appropriate signal a corrected phase obtained by correcting a feed back phase on the basis of a feed back signal with a phase correction value;

a control signal being produced by correcting a drive reference speed signal with a signal relating to a difference between said drive reference phase and said corrected phase and a feedback speed signal so that the drive of said printing unit is controlled with the control signal.

2. A synchronous control system for rotary printing presses comprising driving means provided for independently driving each of a plurality of printing units, a folding unit for cutting and folding a printed paper web into predetermined printing images, and a control section for controlling each of the driving means for said printing and folding units; at least one printing unit having a direct web path running from said one printing unit directly to said folding unit, and a detour web path running to said folding unit via other printing units, characterized in that said control section for said printing unit having said detour web path comprises a drive reference receiving section, a drive reference speed signal output section for producing a signal relating to a drive reference speed on the basis of a drive reference, a drive reference phase signal output section for producing a signal relating to a drive reference phase on the basis of a drive reference, a feedback signal receiving section for receiving a feedback signal on the operating state of said printing unit, a feedback speed signal output section for producing a signal relating to a feedback speed on the basis of said feedback signal, a phase correction signal output section for producing a signal correcting a feedback phase on the basis of said feedback signal, a corrected phase signal output section for producing a signal relating to a corrected phase obtained by correcting a feedback phase on the basis of said feedback signal on the basis of said feedback signal, a phase correction value output section for producing a phase correction value on the basis of the length of an inter-printing unit path running from said printing unit to another printing unit in said detour web path, a phase difference detecting section for detecting a phase difference between said drive reference phase and said corrected phase on the basis of said drive reference phase signal and said corrected phase signal, and a phase difference signal output section for producing a signal relating to a phase difference detected by said phase difference detecting section;

a control signal being obtained by correcting said drive reference speed signal on the basis of a signal relating to sad phase difference between said drive reference phase and said corrected phase, and said driving means for said printing unit being controlled by said control signal via a motor driver.

3. A synchronous control system for rotary printing presses as set forth in claim 1 wherein each of said printing units has a plurality of driven parts, with driving means are provided for driving said driven parts, and control sections are provided for controlling the driving means of each driven part.

4. A synchronous control system for rotary printing presses as set forth in any of claim 1 wherein control sections of said printing units having detour web paths are slave control sections subordinated to a master control section.

5. A synchronous control system for rotary printing presses as set forth in claim 4 wherein each said master control section and said slave control sections has a network connecting section, and is connected to each other with a network line.

6. A synchronous control system for rotary printing presses as set forth in claim 4 or 5 wherein said master control section comprises an input operation section for entering information, etc. needed to operate the rotary printing press, a processing section for operating other components by processing the information entered from said input operation section, and controlling the transmission and receiving of signals to and from said slave control sections, a memory section for storing values for correcting the phase of said driven parts of said printing units in relation to the length of an inter-printing unit path running from said printing unit in said detour web path to another printing unit, and a drive reference setting section for setting a drive reference phase and a drive reference speed.

7. A synchronous control system for rotary printing presses as set forth in claim 6 wherein said drive reference setting section comprises a master pulse signal output section for a first master pulse signal and a second pulse signal every time the output of a predetermined number for said first master pulse signal is completed, a speed setting section for setting a drive reference speed on the basis of said first master pulse signal, and a phase setting section for setting a drive reference phase on the basis of said first master pulse signal and said second master pulse signal.

8. A synchronous control system for rotary printing presses as set forth in claim 2 wherein each of said printing units has a plurality of driven parts, with driving means are provided for driving said driven parts, and control sections are provided for controlling the driving means of each driven part.

9. A synchronous control system for rotary printing presses as set forth in any of claim 2 wherein control sections of said printing units having detour web paths are slave control sections subordinated to a master control section;

said master control section has such a construction that said master control section can transmit drive references, including a drive reference speed and a drive reference phase.

10. A synchronous control system for rotary printing presses as set forth in any of claim 3 wherein control sections of said printing units having detour web paths are slave control sections subordinated to a master control section;

said master control section has such a construction that said master control section can transmit drive references, including a drive reference speed and a drive reference phase.

11. A synchronous control system for rotary printing presses as set forth in claim 5 wherein said master control section comprises an input operation section for entering information, etc. needed to operate the rotary printing press, a processing section for operating other components by processing the information entered from said input operation section, and controlling the transmission and receiving of signals to and from said slave control sections, a memory section for storing values for correcting the phase of said driven parts of said printing units in relation to the length of an inter-printing unit path running from said printing unit in said detour web path to another printing unit, and a drive reference setting section for setting a drive reference phase and a drive reference speed.

* * * * *